US012383032B2

(12) United States Patent
Podda et al.

(10) Patent No.: US 12,383,032 B2
(45) Date of Patent: Aug. 12, 2025

(54) TWO-PART EARRING WITH OPTIMIZED MEANS FOR GUIDING ONE PART INTO THE OTHER

(71) Applicant: FP SYSTEME, Cannes (FR)

(72) Inventors: Florent Podda, Cannes (FR); Sébastien Podda, Cannes (FR)

( * ) Notice: Subject to any disclaimer, the term of this patent is extended or adjusted under 35 U.S.C. 154(b) by 0 days.

(21) Appl. No.: 18/630,526

(22) Filed: Apr. 9, 2024

(65) Prior Publication Data

US 2024/0341418 A1 Oct. 17, 2024

(30) Foreign Application Priority Data

Apr. 13, 2023 (FR) ..... 2303681

(51) Int. Cl.
*A44C 7/00* (2006.01)

(52) U.S. Cl.
CPC ..... *A44C 7/003* (2013.01)

(58) Field of Classification Search
CPC ..... A44C 7/003; A44C 7/006; A01K 11/001; Y10T 24/41
See application file for complete search history.

(56) References Cited

U.S. PATENT DOCUMENTS 1,024,268 A * 4/1912 Mattoni ..... A44C 7/003 24/707.4
12,127,644 B2 * 10/2024 Podda ..... A44B 1/28

FOREIGN PATENT DOCUMENTS

| | | | |
|---|---|---|---|
| DE | 1557637 | A1 * | 11/1967 |
| FR | 3104912 | A1 | 6/2021 |
| JP | 2003250613 | A | 9/2003 |
| SE | 373805 | C * | 4/1920 |
| WO | 9221262 | A | 12/1992 |

* cited by examiner

*Primary Examiner* — Jack W Lavinder

(57) ABSTRACT

An earring includes a pointed pin adapted to be reversibly inserted into a receiving housing provided with a means for guiding the pin, the receiving housing also including at least one seal. The guide means is formed by a concavity whose bottom is open, a diameter of the open base of the concavity being at least 30% greater than an outer diameter of the receiving housing, a depth of the concavity being equal to half a length of the receiving housing. The pin is provided with at least two circular grooves suitable for temporarily receiving two annular seals when the pin is inserted into the slot of the two annular seals.

5 Claims, 2 Drawing Sheets

[Fig. 1]
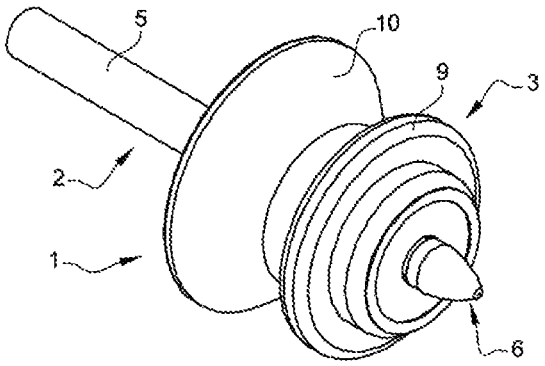
[Fig. 2]
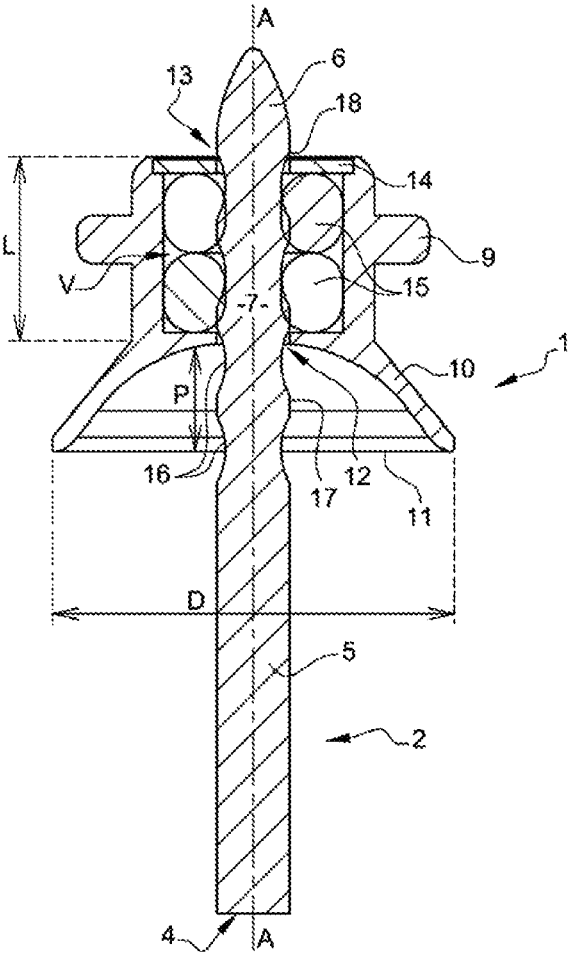

[Fig. 3]
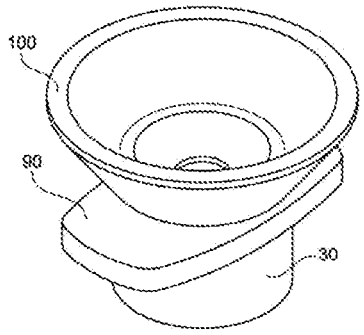
[Fig. 4]
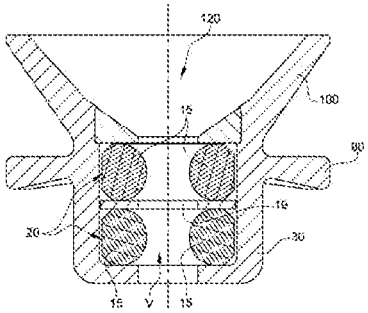
[Fig. 5]
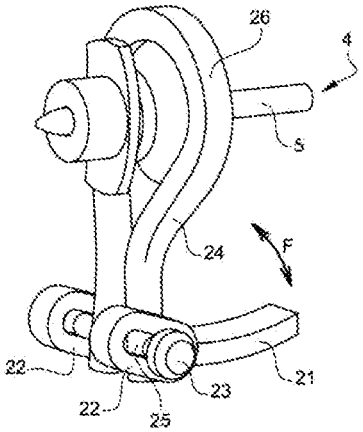

TWO-PART EARRING WITH OPTIMIZED MEANS FOR GUIDING ONE PART INTO THE OTHER

The present invention relates to a two-part earring with optimized means for guiding one part into the other.

Here, the term "earring" refers to any piece of jewelry worn on at least one ear by a person, regardless of the shape, size, nature and/or color of the decorative part of the jewelry. The invention concerns earrings that are held in position on the ear by a pin inserted into a piercing in the lower part of the ear, known as the lobule. The pin is, on one side of the lobule, secured to the decorative part of the earring and, on the other side of the lobule, connected removably to a securing element preventing the pin from accidentally coming out of the piercing.

DESCRIPTION OF THE RELATED ART

It is understood that the connection between the securing element and the pin must, on the one hand, be sufficient to ensure that the earring remains in place regardless of what the wearer is doing and, on the other hand, allow the earring to be easily inserted and removed by the wearer, whether or not that person has a mirror. FR-B-3 104 912 teaches an earring whose securing element receiving the pin is equipped with a means for guiding the pin into the securing element. The guiding means is configured as a cone and formed of two similarly shaped parts fitted coaxially one inside the other. A cylinder fitted with rings and seals in its inner volume extends the conical part and holds the pin into the securing element. While such a solution, thanks to the guiding means, allows easy placement of the earring on the ear lobule, without the need for the wearer to look or fumble, the fact remains that such an earring comprises a significant number of parts. In addition, a conical shape for the guiding means is not optimal because the person must correctly position the pin at the center of the cone for easy insertion. The rings and seals ensure effective retention of the pin in the securing element, but offer relatively significant resistance to taking out the pin, which does not allow easy for separation when the person wishes to remove the earring. Because of this, in addition to complex and relatively expensive manufacturing, such a solution is not optimal.

It is these needs that the invention proposes to remedy by offering an earring that is easy and quick to install thanks to simple guiding means while having a small number of parts.

BRIEF SUMMARY OF THE INVENTION

To this end, the subject of the invention is an earring comprising a male part configured as a pointed pin, one end of which opposite the point is provided with a decorative element, the pointed end being adapted for reversible insertion into a receiving housing formed in a female part of the earring, the receiving housing being cylindrical and provided, at its opening, with a means for guiding the pin into the receiving housing when the pin is inserted into the housing, the cylindrical housing also comprising at least one seal, the guiding means being formed by a concavity at one end of the cylindrical receiving housing, the base of which is open and defines an access opening to the housing, the diameter of the open base of the concavity being at least 30% greater than the external diameter of the cylindrical housing, the depth of the concavity being equal to half the length of the cylindrical housing and in that at least part of the pin is provided with at least two circular grooves, parallel and oriented perpendicularly to a main longitudinal axis of the pin, said grooves being adapted to temporarily receive two annular seals when the pin is inserted into the slot of the seals themselves inserted in the cylindrical housing, characterized in that the concavity is parabola-shaped or in the form of a double-sloped cone and in that the receiving housing is equipped with a plate perforated at its center and arranged parallel to the bottom of the housing, said plate ensuring separation between the seals arranged in the receiving housing while allowing the pin to pass freely into the receiving housing.

The invention thus makes it possible, with a simple guiding means and with minimal parts, to position the pin precisely and rapidly in the receiving housing. The person ensuring the placement of the earring, whether they are the wearer of the earring or not, not only can easily place the earring without fumbling around, but also easily remove it without effort and without pulling on the lobule of the ear.

According to advantageous but optional aspects of the invention, such an earring may comprise one or more of the following features:

One end of the pin is configured as a blunt-tipped bullet shape.

The bottom of the housing for receiving the pin is provided with an orifice for the passage of the bullet-shaped end of the pin when the latter is in the holding position in the housing.

The bottom of the receiving housing provided with the orifice is removable.

The seals are provided with a flat external face adapted to bear against the inner face of the receiving housing.

BRIEF DESCRIPTION OF THE SEVERAL VIEW OF THE DRAWING

The invention will be better understood and other advantages thereof will become more clearly apparent on reading the following description, given solely by way of non-limiting example and with reference to the accompanying drawings, wherein:

FIG. 1 shows a perspective view of an earring according to one embodiment of the invention, in mounted position, the decorative part of the earring not being shown nor the lobule of the ear, FIG. 2 is a longitudinal sectional view, on another scale of the earring of FIG. 1, FIG. 3 is a perspective view, on another scale, of the only female part and therefore of the cylindrical receiving housing according to another embodiment of the invention, FIG. 4 is a longitudinal sectional view on another scale of the female part shown in FIG. 3, and FIG. 5 is a partial perspective view of an earring according to another embodiment of the invention.

DETAILED DESCRIPTION OF THE INVENTION

FIG. 1 is an illustration of an earring 1 according a first embodiment of the invention. An earring 1 comprises a male part 2 removably inserted into a female part 3 defining a receiving housing. Subsequently, the expression "receiving housing" will preferentially be used. Here, the so-called male part 2 is configured as a pin. This term will preferentially be used subsequently. The pin 2 is shown without any decorative element of the earring 1 attached to a free end 4 of the pin 2. The pin 2 is shown inserted into the female part 3 of the earring 1, therefore in the configuration of the earring 1 when the latter is in place on the lobule of a ear, not shown. It is understood that in such a configuration, a straight part 5 of the pin 2, visible in FIG. 1, is inserted into a piercing in the lobule of the ear. Thus, on one side of the lobule is the female part 3 comprising a recess for receiving a pointed end 6 of the pin 2, and on the other side of the lobule is the decorative part of the earring 1.

The constituent material of such an earring 1 is preferentially a metal, for example gold. Alternatively, it may be another material or even a composite material. Likewise, the outside dimensions and/or the shape of the female part 3 may be different from those shown. As can be seen in FIG. 1, the pin 2 comprises, opposite its free end 4 which is normally connected to the decorative element of the earring 1, a blunt pointed end 6. This pointed end 6 is advantageously bullet- or ball-shaped, with a rounded end. The tip 6 of the pin 2 passes through the entire receiving housing 3, in the central position thereof. Only the tip 6 of the pin 2 emerges out from the receiving housing 3. A part 7 of the body of the pin 2 extends into the receiving housing 3, over the entire length thereof and beyond, from an outlet opening 13 of the receiving housing 3.

The receiving housing 3 is configured in a cylinder with a circular base. The term cylinder will also be used hereinafter to designate the receiving housing or female part 3 of the earring 1. Alternatively, the external shape of the receiving housing is different from those shown in FIGS. 1 to 4. For example, it may be octagonal, faceted, rectangular, or square. In all cases as will be detailed below, the internal volume V of the receiving housing 3 is, in the present example, cylindrical with a circular base.

Substantially in the central part, along the length, of the external face of the cylinder 3, a flat relief 9 extends radially towards the outside of the cylinder 3 over the entire circumference thereof. Alternatively, the dimensions of this relief are different, as is its position. In another embodiment, there are tabs extending radially outwards from the cylinder 3. In all cases, regardless of the shape and/or the dimensions of this relief or of these tabs, there is a member for gripping the earring 1, more precisely the female part 3 constituting the receiving housing. Such a gripping member allows the female part 3 of the earring 1 to be easily held when placing and removing the pin 2, which is preferentially handled from the decorative element attached to its end 4. It is easily understood that the dimensions and/or the weight of the assembly are sufficient to allow its handling while remaining within values that avoid pulling on the lobule of the ear.

The open part 10 of one end of the cylindrical receiving housing 3 through which the pin 2 is inserted is concave. The open circular base 11 of the concavity 10 is of dimensions such that its diameter D is at least 30% greater than the outer diameter of the cylinder 3 defining the housing for receiving the pin 2. The depth P of the concavity 10, therefore the distance between the circular base 11 and the open top or bottom 12 of the concavity 10 which connects the latter to the internal volume V of the cylinder 3, is equal to about half the length L of the cylinder 3. In other words, the dimensions of the concave opening 10 of the cylinder 3 are such that when the pin 2 is present for its insertion, it is required to pass through the concave opening 10 while being guided in this movement. There is therefore no risk of striking the outside of the receiving housing 3 or of missing the opening 10 of the receiving housing 3 when presenting the pin 2 in front of the receiving housing 3.

FIG. 2 is a longitudinal cross-section of the earring 1 of FIG. 1 along a plane comprising a main longitudinal axis AA of the receiving housing 3. As shown in FIG. 2, this axis AA coincides with the longitudinal axis of the pin 2 when the latter is inserted into the receiving housing 3. It should be noted that the internal volume V of the receiving housing 3 is here configured as a hollow cylinder with a circular base, as the external configuration of the receiving housing. Alternatively, it may have another shape and/or other dimensions. In all cases, the internal volume V of the receiving housing 3 comprises an access opening defined by the open bottom 12 of the concave part 10 and an orifice 13 provided in the central position on the bottom wall 14 of the cylinder 3, therefore a coaxial orifice 13 opposite the opening 12. This orifice 13 defines an exit from the cylinder 3 for the tip 6 of the pin 2.

The internal volume V of the cylinder 3 receives at least two annular seals 15 whose dimensions and shape are adapted to those of the internal volume V. Thus, the opening of the seals 15 delimits a central part of the volume. This central part—and therefore the light of the seals 15—is cylindrical with a circular base with a diameter corresponding to the diameter of the openings 12 and 13, the seals 15 also occupying the entire available length of the volume V of the cylindrical housing 3 while being arranged parallel to the bottom 14. Such a configuration allows the pin 2, when inserted into the volume V from the concave opening 10, to pass through the cylindrical housing 3 over the entire length L thereof by passing through the opening of the annular seals 15 and by exiting, via its tip 6, through the orifice 13 provided in the bottom 14 of the cylinder 3. This bottom 14 of the cylinder 3 is advantageously constituted by a plate attached to the cylinder 3 once the seals 15 are in place in the volume V. Advantageously, the plate defining the bottom 14 is inserted by snap-fastening or crimping so as to be removable in order to access the internal volume V to change the seals 15 if necessary or perform any type of intervention in the volume V. Alternatively, the bottom 14 is attached to the cylinder 3 in a definitive manner by welding, gluing or other technique known per se.

As is apparent from FIG. 2, the part 7 of the pin 2 located generally between the rear of the bullet-shaped tip 6 and the part 5 of the pin 2 extending outside the opening 10 of the cylinder 3 comprises grooves 16 with a rounded bottom. In other words, the part 7 of the pin 2 adapted to be removably inserted into the housing 3 is provided with grooves 16 giving a notched appearance to this part 7 and at least two. The grooves 16 are arranged radially on the pin 2, over the entire circumference of the pin 2. Several parallel grooves 16 are thus produced over the length of a part of the pin 2, here the part 7 of the pin. The dimensions, shape, and arrangement of the grooves 16 are complementary to those of the seals 15. A temporary connection is thus produced by cooperation of shapes between the pin 2 and the seals 15.

When the pin 2 is forcibly inserted into the receiving housing 3, according to a translational movement oriented parallel to the axis AA of the cylinder 3, the seals 15 are compressed when the zone 17 of the pin 2 located between two grooves 16 comes into contact with the seals 15, and the seals 15 are released from the grooves 16 when the translational movement continues and the grooves 16 and seals 15 are facing each other. Due to the cooperation of shape and the number of seals 15 in position in the grooves 16, when the pin 2 is in place in the volume V, any accidental translational movement of the pin 2 aiming to take the pin 2 out of the housing 3.

Holding the pin in position in the cylinder is obtained and optimal when the bullet-shaped tip 6 is removed from the orifice 13 of the bottom 14 of the cylinder 3. In this case, the rear 18 of the tip 6 bears on the outer edge of the orifice 13 and a maximum number of seals 15 is in place in the grooves 16 of the pin 2. The extraction of the pin 2 from its housing 3 is done by pulling the pin 2, therefore with a translational movement in the opposite direction to that made to insert the pin into the cylinder. The insertion and removal movement of the pin 2 is facilitated by the flat relief 9 or gripping member which allows the person to have an optimal grip of the female part 3 of the earring 1, the pin 2 being manipulated by gripping the decorative part attached to the end 4 of the pin 2.

As is noted in FIG. 2, the internal part of the concave opening 10 is here configured in a parabola, which makes it possible when the tip 6 of the pin 2 is present for the latter to slide in a guided manner on the inner wall as far as the access opening 13 inside the cylinder 3. The parabolic shape of the interior of the concavity 10 allows so-called automatic guidance of the pin, in the sense that a person can perform the maneuver without looking at what they're doing. Likewise, the centering of the pin 2 in the opening 13 and therefore in the volume V and the slot of the seals 15 is automatically obtained by the parabolic shape of the opening 10. The diameter D of the parabolic opening 10 is sufficiently large, including in the vicinity of the bottom 14 of the parabola, so that there is no jamming phenomenon during the movement of the pin 2 towards the housing 3. Alternatively, the inner wall of the parabola is coated with a non-adherent material, for example polytetrafluoroethylene (PTFE) in order to facilitate the sliding of the tip 6 into the parabolic opening 10.

FIG. 3 shows one embodiment of the invention. The elements having functions similar to those of the elements of FIGS. 1 and 2 have the same references multiplied by ten here, the gripping member 90 of the recess is formed by two flat tabs extending radially outwards from the outer wall of the cylinder 30 and diametrically arranged. In this embodiment, the concave opening 100 is configured, at least inside, with a double-sloped cone as can be seen more particularly in FIG. 4. The production of a double-sloped straight inner wall for the concavity 100 is technically simpler to produce than a parabolic-shaped curved wall. The break in slope in the vicinity of the orifice 120 for accessing the cylinder 3 optimizes the guidance of the pin 2 during its insertion into the housing 3.

The presence of a pierced plate 19 positioned between two seals 150 and oriented perpendicular to the main longitudinal axis AA of the cylindrical housing 3, therefore parallel to the bottom 14 of the receiving housing 3, is also noted. The opening and the position of the plate 19 allow the free passage of the pin 2 into the cylindrical housing 3. The function of this plate 19 is to separate the seals 150 and to avoid any sticking phenomenon between the seals 150, which remain independent and held in place in the volume V. In addition, the holding in place of these seals 150 is facilitated by the fact that they have a flat, non-rounded external face 20 to bear against the rectilinear inner wall of the cylinder 3. The only possible movements of the seals 150 are compression and release movements in a direction perpendicular to the longitudinal axis AA of the housing 3. There is no possibility that the seals 150 will move within the housing 3.

The embodiment of the invention shown in FIG. 5 is particularly suitable for relatively heavy and bulky ears which are held not only on one end of a pin, but also on an articulated tab or index bearing against the rear of the ear. In this way, any effort and deformation of the lobule of the ear is avoided. A decorative part, not shown, is attached on the one hand to the end 4 of the pin 5 and, on the other hand, to one end of a flat tab 21. The other end of the tab 21 comprises two reliefs 22 each provided with a through-hole. The reliefs 22 thus define a hinge adapted to receive a pin 23. The rest of the earring is that, shown in FIGS. 3 and 4, therefore with tabs 90, it being understood that this could be that of FIGS. 1 and 2.

An element 24 is configured in an omega or racket shape whose central part is empty. The free ends 25 of the element 24 are each pierced with a through-hole, similar to the orifices of the reliefs 22. As appears in FIG. 5, when the ends 25 are positioned between the reliefs 22 and the pin 23 is in place, the element 24 and the tab 21 are articulated relative to each other, these elements can be brought closer together or spaced apart by the double arrow F.

The rounded part 26 of the element 31 is adapted, in dimensions and in geometry, to receive the concave part 100. Thus, the inner face of the part 26 that defines the limits of the central orifice of the part 26 is beveled, so as to have a shape complementary to the outer wall of the concavity 100.

Thus, when the earring is placed, the concavity 100 is first positioned in the part 26, then the decorative part is placed and the element 24 on either side of the lobule of the ear is placed by pivoting the tab 21 and the element 24 according to the double arrow F, the pin 2 is then presented in the concavity 100 and, as described above, the pin 2 is secured to the cylinder 30. It is ensured that a relatively large and heavy earring is held in position without effort on the earlobe and with simple placement.

In all cases, regardless of the embodiment, the concavity 10; 100 has dimensions such that it makes it possible, by its open base, to press the female part 3; 30 forming the housing for receiving the pin 2 against a face of the lobule with a bearing surface such that the pressure exerted on the lobule by the female part 3 or 30 is low and substantially balanced with the pressure exerted by the decorative part mounted on the pin 2 on the opposite face of the lobule, which contributes to reducing the feeling of compression and improves the comfort of the person wearing the earring 1.

The invention claimed is:

1. An earring (1), comprising a male part (2) configured as a pointed pin, one end (4) of which opposite a pointed end (6) is provided with a decorative element, the pointed end (6) being adapted for reversible insertion into a receiving housing formed in a female part (3; 30) of the earring (1), the receiving housing (3; 30) being cylindrical and provided, at an opening, with a means (10; 100) for guiding the pointed pin (2) into the receiving housing (3; 30) when the pointed pin (2) is inserted into the receiving housing, the receiving housing (3; 30) also comprising at least one seal (15), a guiding means being formed by a concavity (10; 100) at one end of the cylindrical receiving housing (3; 30), a base (12) of which is open and defines an access opening to the receiving housing, a diameter (D) of the base (12) of the concavity (10; 100) being at least 30% greater than an external diameter of the receiving housing (3; 30), a depth (P) of the concavity (10; 100) being equal to half a length (L) of the receiving housing (3; 30) and in that at least part (7) of the pointed pin (2) is provided with at least two circular grooves (16), parallel and oriented perpendicularly to a main longitudinal axis (AA) of the pointed pin (2), said two circular grooves (16) being adapted to temporarily receive two annular seals (15) when the pointed pin (2) is inserted into a slot of the two annular seals (15) themselves inserted in the receiving housing (3; 30), wherein the concavity (10, 100) is parabola-shaped, or, at least inside, with the form of a double-sloped cone, and in that the receiving housing (30) is equipped with a plate (19) perforated at a center of the plate (19) and arranged parallel to a bottom of the receiving housing, said plate (19) ensuring separation between the two annular seals (15) arranged in the receiving housing (30) while allowing the pointed pin (2) to pass freely into the receiving housing (30).

2. The earring according to claim 1, wherein the pointed end (6) of the pointed pin (2) is instead configured as a blunt-tipped bullet shape.

3. The earring according to claim 2, wherein the bottom (14) of the receiving housing (3; 30) of the pointed pin (2) is provided with an orifice (13) for passage of the bullet-shaped end (6) of the pointed pin (2) when the latter is in a holding position in the receiving housing (3; 30).

4. The earring according to claim 3, wherein the bottom (14) of the receiving housing provided with the orifice (13) is removable.

5. The earring according to claim 1, wherein the two annular seals (15) are provided with a flat outer face (20) adapted to bear against an inner face of the receiving housing (30).

* * * * *